United States Patent [19]

Rewitzer

[11] Patent Number: 4,526,094

[45] Date of Patent: Jul. 2, 1985

[54] PROCESS AND DEVICE FOR PACKING STAPLE FIBERS INTO BALES

[75] Inventor: Siegfried Rewitzer, Ihrlerstein, Fed. Rep. of Germany

[73] Assignee: Hoechst Aktiengesellschaft, Fed. Rep. of Germany

[21] Appl. No.: 566,173

[22] Filed: Dec. 28, 1983

[30] Foreign Application Priority Data

Dec. 31, 1982 [DE] Fed. Rep. of Germany ..... 3248712
Nov. 19, 1983 [DE] Fed. Rep. of Germany ..... 3341882

[51] Int. Cl.[3] ..... B30B 15/30

[52] U.S. Cl. ..... 100/35; 100/45; 100/99; 100/215; 100/229 R; 141/83; 177/146

[58] Field of Search ..... 100/35, 215, 99, 229 R, 100/45; 141/83, 80; 177/146; 222/77

[56] References Cited

U.S. PATENT DOCUMENTS

| | | | |
|---|---|---|---|
| 615,493 | 12/1898 | Richards | 100/99 X |
| 1,340,964 | 5/1920 | Ligon | 100/45 |
| 2,993,546 | 7/1961 | Slattery | 100/99 X |
| 3,220,500 | 11/1965 | Wilmeth | 100/99 X |
| 3,386,372 | 6/1968 | Knipp | 100/35 |
| 3,608,476 | 9/1971 | Price | 100/215 X |
| 3,611,673 | 10/1971 | Carkhuff | 141/80 X |
| 3,805,689 | 4/1974 | Berger | 100/215 X |
| 3,916,778 | 11/1975 | Van Doorn et al. . | |
| 4,137,976 | 2/1979 | Grayson . | |
| 4,162,603 | 7/1979 | Strömberg . | |
| 4,318,264 | 3/1982 | Rewitzer . | |

FOREIGN PATENT DOCUMENTS

| | | | |
|---|---|---|---|
| 2460213 | 7/1975 | Fed. Rep. of Germany . | |
| 2819807 | 10/1978 | Fed. Rep. of Germany . | |
| 2849900 | 5/1980 | Fed. Rep. of Germany . | |
| 2911958 | 10/1980 | Fed. Rep. of Germany . | |
| 2922353 | 12/1980 | Fed. Rep. of Germany | 141/83 |

*Primary Examiner*—Billy J. Wilhite
*Attorney, Agent, or Firm*—Connolly and Hutz

[57] ABSTRACT

The invention relates to processes and devices for packing staple fibers into bales of identical weight. By using transportable press containers and load-measuring devices which permit a weighing of the press container, including its contents, in the prepress between the individual pressings without touching sealing devices, makes it possible to determine the weight increase of the press container per clearing motion and to predetermine the total number of clearer motions required for reaching a predetermined bale weight.

The invention permits the production of bales whose weight fluctuates, for example, by only ±2 kg or, if a stroke-reducible clearing device is used, by only less than ±1 kg.

10 Claims, 5 Drawing Figures

1
40
55
49
45
48
47
54
46
11'
51
53
11
42
43
44
50
10
56
41
8
2
57
11"
4
5
12
52
3
6
7
58

PROCESS AND DEVICE FOR PACKING STAPLE FIBERS INTO BALES

The invention relates to a process for packing staple fibers into bales of ideally identical weight and to suitable devices for carrying out the process.

It has long been the desire of, for example, fiber manufacturers to pack their products into bales of ideally identical weight. Identical bale weights make it easier for the customer to plan his production, and they also give reproducible results at the fiber manufacturer's under optimum conditions.

There has therefore been no shortage of attempts to derive the filling weight for a bale from quantities measured in the course of baling. Suitable quantities appear to be for one the power consumed by the pressing ram until the ram has reached a specific position and/or the measurement of the time necessary under the application of a specific given force for a specific position of the ram of the press to have been reached. However, it is known from experience that measuring methods of this type are only sufficient to maintain a specific target value within wide tolerance ranges of, for example, ±20 kg.

German Pat. No. 2,460,213 discloses a combination of various measuring methods of this type where, in addition to a pressure sensor, at least one position sensor is used.

German Offenlegungsschrift No. 2,819,807, for example, proceeded along another path by weighing out batches of the staple fibers as they fall through a chute. This method is likewise only suitable for obtaining a rough estimate of the weights, since this weighing method is prone to a number of errors.

More accurate processes and devices are described in, for example, German Offenlegungsschrift No. 2,849,900, where there is provided, ahead of the prepress, a special weighing device which first collects the incoming staple fibers into batches in a precision weighing device before they are only then passed on to the prepress. An additional weighing device of this type is, in the disclosed form, technically very complicated.

Direct weighing of the deposited fiber material has never been attempted. The reasons for this are obvious. The press box used in the prepress is customarily part of a revolving press, i.e. free movement of the press box in the vertical direction, as would be necessary for determining the weight, is impossible if only for constructional reasons. Moreover, direct application of load-measuring devices in the prepress would also always be afflicted with the disadvantage of low sensitivity or of a large relative error, since such load-measuring devices would have to absorb not only the weight of the press container and of the deposited fiber but also the force of the pressing ram.

German Offenlegungsschrift No. 2,911,958 describes, for the first time, the use of transportable press containers, which no longer have a rigid connection to the prepress or mainpress system.

It is therefore, as ever, still the object of the invention to provide a process and a device for packing staple fibers into bales of uniform weight by making only slight changes to the devices used, but in particular avoiding a complicated weighing mechanism ahead of the prepress.

This object is achieved by a novel process and additional devices on the prepress, the prepress being of the type described in German Offenlegungsschrift No. 2,911,958, i.e. the prepress being in particular of the type which makes use of a transportable press container without any rigid connection to the prepress or a downstream final press.

It is known to pack staple fibers into bale form by multistage pressing, which involves introducing the staple fibers by means of a clearer in pushsized batches out of a chute and into a transportable press container and, after every several such pushes by the clearer, compacting the accumulated fiber material into the transportable press container by means of a pressing ram. When the pressing ram has been removed from the press container, further staple fibers are cleared by means of the clearer in pushsized batches into the prepress or the transportable press container. The press container filled with prepressed staple fibers is then directly passed to a central press for final pressing. According to the invention, after an empty press container has been moved into the prepress, this transportable press container is first of all subjected to a weighing by lifting the press container from its base by means of lifting devices, so that it is only carried by load-measuring devices which are present on the lifting devices. Furthermore, it is necessary for the sealing devices, which are in contact with the press container, to be removed from the press container before correct weighing can be carried out. After this determination of the tare weight of the press container, the lifting devices are retracted, the press container is back on the base plate, and the sealing devices make a seal between the transportable press container and the upper part of the press. The staple fibers are then started to be introduced, and compressed, in a conventional manner by discharging, from a chute, the accumulated staple fibers in pushsized batches by means of a rakelike clearer. In conventional manner the pressing ram is not set in motion until after a predetermined number of clearing motions and is pressed onto the fiber material present in the press container. When the pressing ram has been raised again, the press container is filled some more through a predetermined number of clearing motions of the clearer, followed again by a prepressing by means of the pressing ram. This way of introducing and precompacting staple fibers within a prepress has been known for a long time. The crucial difference with the process according to the invention is that, after a predetermined number of movements by the pressing ram or after a predetermined number of pushlike movements by the clearer, the filling of the transportable press container is briefly interrupted and the weight of the then partially filled container is determined as in the case of the tare weight determination by means of lifting devices and load-measuring devices attached thereto. The resulting measurements are processed in a central unit. The quanities calculated are, in addition to the actual weight of the material deposited to date, the average weight of a clearing push and at the same time the number of clearing motions which still have to be made until a target weight has been reached. The prepress is then operated again in a conventional manner, i.e. further staple fibers are introduced by the clearer and then compacted by means of the pressing ram.

When the precalculated number of clearing motions is reached, the continued filling is interrupted, and the filled press container is transported away and replaced by a new one.

The process according to the invention can be made more refined by weighing the press container once more shortly before the precalculatcd target number of clearing motions is reached, and thus permitting a still more accurate determination of the average weight per clearing motion and also determination of the number of pushes still required from the clearing device. In this way the target weight can be maintained with considerable accuracy. In this case the fluctuation of the bale weight is still about half the average weight of a clearing motion, i.e., for example, about ±2 kg.

If this accuracy is still not adequate in a particular case, there can be provided a further device for metering staple fibers, which, for example, again operates like the clearing device but with a smaller amount.

However, the metering of smaller amounts of fiber can also be made possible by changing the guide geometry of the clearing device used. In the case of commercially available clearers, such a change in the geometry can be accomplished, for example, by replacing a guide lever by a variable guide system or reducing the distance of the teeth from their axis of rotation.

The device which is necessary according to the invention consists of a prepress as described, for example, in German Offenlegungsschrift No. 2,911,958. It has in particular a transportable press container which can be introduced into the prepress. The staple fibers are supplied in conventional manner by way of a chute whose lower end is about horizontal at the point where it joins the upper part of the prepress. At this join there is a clearer which has a plurality of teeth which, in a kind of grab motion, always push one batch of stable fiber into the upper part of the prepress.

According to the invention, it is necessary that this prepress has special lifting devices for the transportable press container, which are capable of lifting the press container in such a way that it no longer is in contact with any other parts of the device. Mounted on these lifting devices there are load-measuring devices which can determine the weight of the container including contents.

To be able to perform a satisfactory measurement, it is necessary for the sealing devices, which are required during filling, to have been removed from between the upper part of the press and the movable press container. This can be accomplished with appropriate transporting devices, for which, of course, the sealing devices need likewise to be mounted in a manner permitting them to be moved.

To operate such a prepress with weighing device, it is necessary for the resulting measurements to be processed in a central control unit, i.e. for the tare weight to be recorded there as the empty press container is weighed, followed by the filling weight when filling is about two thirds through. In addition, the number of strokes by the clearing device should be noted, and the measured filling weight and the number of clearing motions should be used to calculate the average weight per clearing motion and the number of clearing motions still required. Such control and arithmetic processing systems are known in principle, making an exhaustive explanation unnecessary here. If desired, a second metering device may be provided for small amounts of staple fibers, so that, towards the end of the filling, 1 or 2 kg can be added, as required, to the fiber already in the prepress.

Another way of metering reduced amounts per clearing push by changing the guide geometry of the clearing device will be described below.

The attached figures are to explain the invention in more detail by describing illustrative embodiments as follows:

FIG. 1 shows a prepress in cross-section with a lifting device sketched in;

Figure 1:
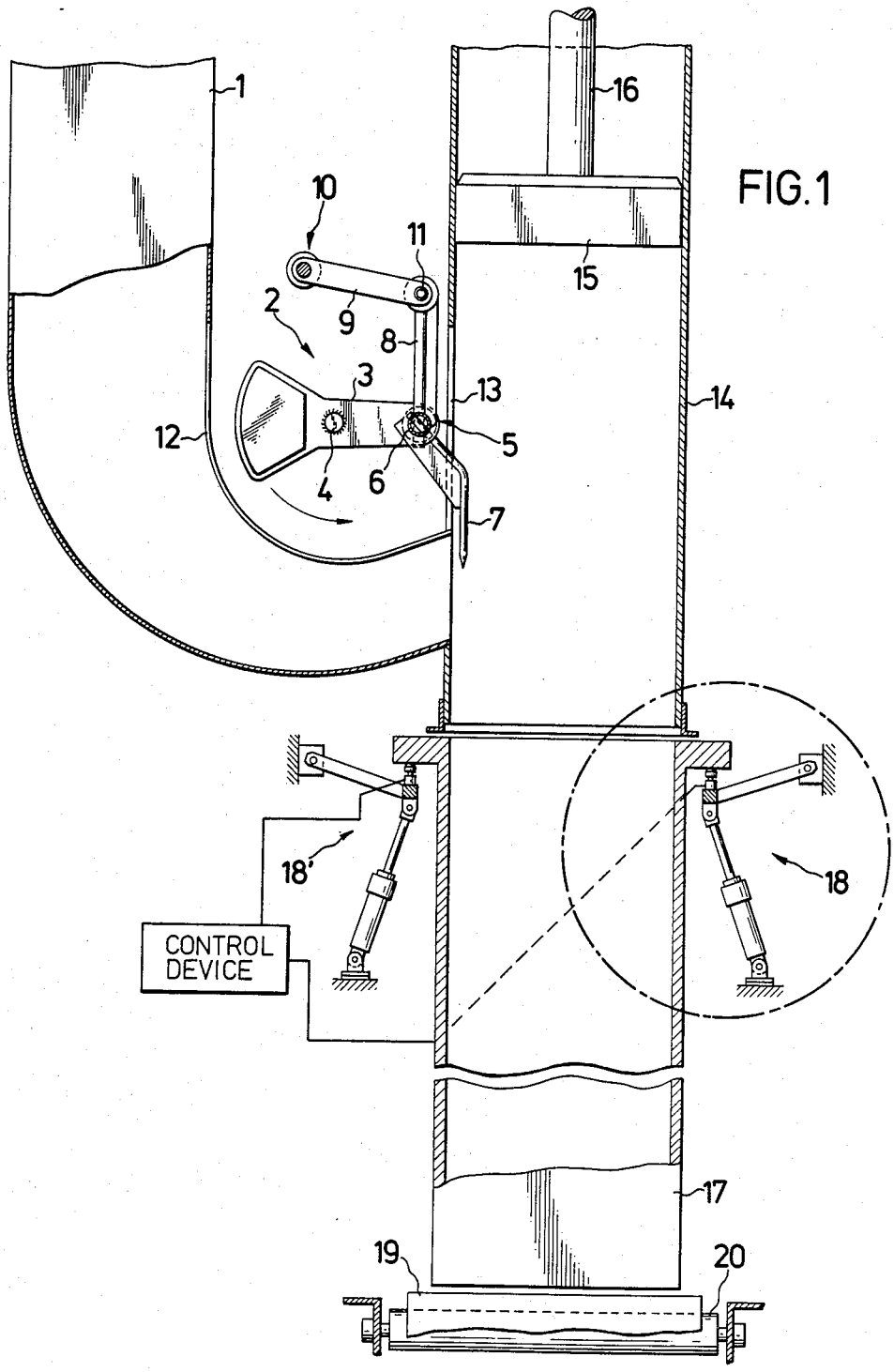

The staple fibers to be packed are introduced by conveyor devices into the chute 1, where they accumulate without, however, in particular if the clearing device 2 is appropriately positioned, growing beyond the horizontal branch.

This clearing device 2 consists of an arm 3 which is moved above the axle 4 and which, at the turning point 5, supports an axle 6 having a plurality of teeth 7. The position of the teeth 7 during the turning motion by the arm 3 about the axle 4 is predetermined by a lever system 8, 9, the turning point 10 being firmly fixed to the housing, in contrast to axis 11, which is freely mobile. In the course of arm 3 turning, the teeth 7, owing to their being coupled to the lever system 8, 9, make a grablike motion which grabs into the horizontal part of the chute 1, the teeth 7 acting in the chute 1 by virtue of the presence of openings 12 and in the upper part of the press by virtue of the presence of openings 13. The actual press comprises the upper portion 14 and the pressing ram 15, which can be moved up and down by means of a piston rod 16.

In the lower part of the press, there can be seen the transportable press container 17, which has been lifted from the base 19 by means of lifting and load-measuring devices 18, 18'. A roll 20 of a roll conveying section has also been sketched in. This roll transporting device normally delivers the empty transport containers and takes away the filled press containers. The base 19 customarily also has centering devices which ensure that the press container is accurately positioned relative to the prepress, in particular relative to the pressing ram 15. Such centering devices have not been shown here, since they are not part of the subject-matter of the invention. The base plate 19 is customarily extendable. In this way the gap between the press container 17 and the upper part of the press 14 can be narrowed, while, at the same time, the roll conveying belt is relieved from the pressing forces of the pressing ram 15.

Figure 2:
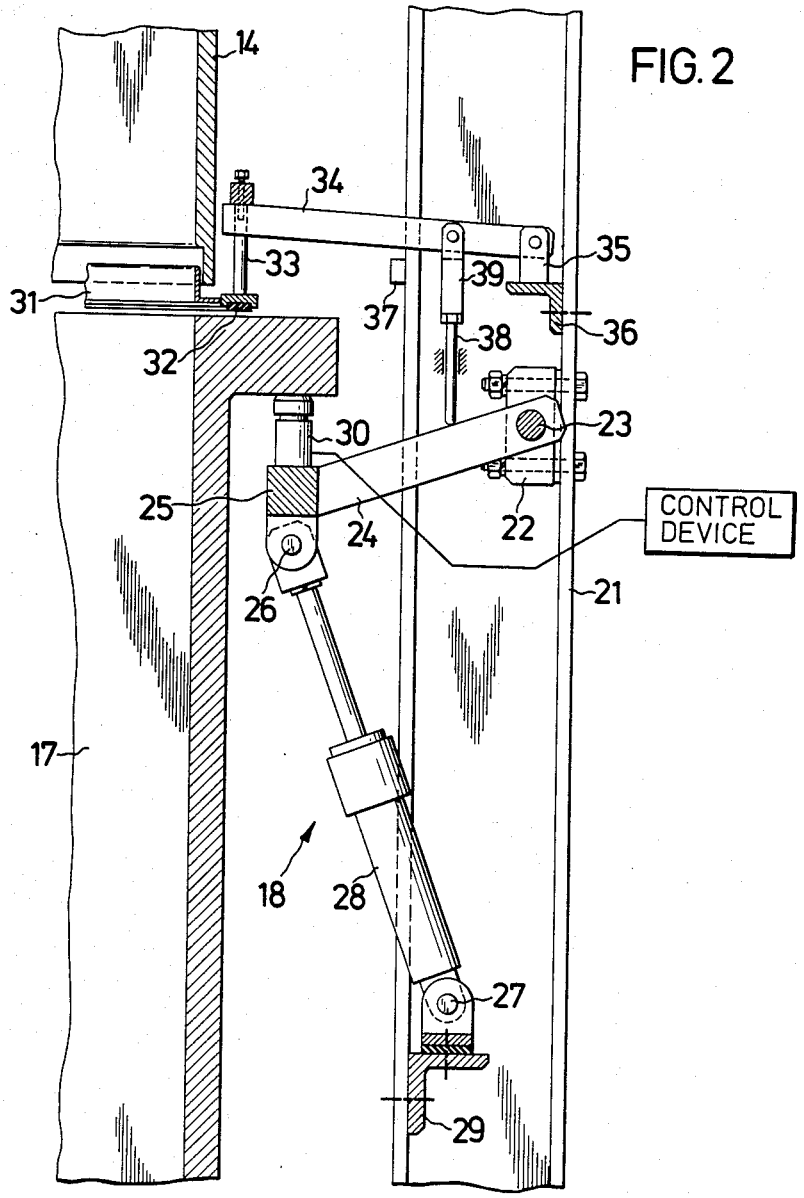
FIG. 2 shows in detail an excerpt from FIG. 1 likewise in cross-section.

The specific situation at the upper edge of the container 17 near the lifting and load-measuring device 18 has been depicted once more in detail in FIG. 2. It can be seen that the lifting and load-measuring device has been fixed movably at this side of the prepress to a frame support 21, on the one hand via bearing 22, axle 23, lever 24 and rod 25, and on the other via bearing bolts 26, 27, an adjusting device 28 and a supporting angle 29. The actual load cell 30 is mounted on the rod 25.

On extending the adjusting device 28, the rod 25 and hence the load-measuring device 30 or the measuring devices are pivoted outwards and moved underneath the rim of the transportable press container 17 and the press container 17 is hence lifted. To protect the measuring device, it should be ensured by means of suitable locking devices that during measuring, i.e. during the use of the lifting and load-measuring device 18, the pressing ram 15 must not be used.

In FIG. 2 there can further be seen a sealing device which consists of a framelike structure 31 which is bounded by a flexible seal 32 extending along the frame. This sealing frame 31, with seal 32, is supported by a plurality of lever and rod systems 33, 34 as well as by supports 35, 36.

In this embodiment, an abutment 37 serves to restrict the length of the downward path of the seal. A special pushrod system 38, 39 is connected to the lever 34. This pushrod senses the position of the lever 24. As the lifting and load-measuring system 18 is extended, the pushrod 38, 39 and hence the lever system 34, 33 are also raised, and consequently the frame system 31, with seal 32, is also raised, to such an extent that the seal 32 and of course also the frame 31 are no longer in contact with the raised press container 17.

As has already been explained, a special illustration of the measuring and regulating systems in detail was thought unnecessary. It may just be pointed out that measuring devices do of course have to be present in order to record the number of revolutions or lifting motions of the clearing device 2. It is furthermore advantageous to monitor the fullness of the chute 1 by means of light barriers or the like. In this way it is possible, in a preferred embodiment of the process, to leave the pressing ram 15 on the material to be pressed in the container 17 until sufficient material has again been accumulated in the chute by a conveying device not depicted, so that the next pregiven number of clearing motions can be carried out without any quantities missing.

It may also be pointed out that the press container 17 must usually also have spring-mounted retaining flaps in order to stop the prepressed material from creeping back out of the container. Such retaining flaps or fingers are known, and they have therefore not been depicted in the figures.

As has already been mentioned, the metering in of smaller amounts of fiber then produced by a push by the clearing device is also possible by changing the guide geometry of the clearing device used.

Such a change can, for example, be effected by replacing the lever arm 9 in FIG. 1 by a guide system 40 with a movement device 49. Such an embodiment is depicted in FIG. 3.

In this embodiment, the guide system 40 comprises four levers 42, 43, 44 and 45, which are connected movably to one another via the bearings 46, 47 and 48 and via the turning point 10, and a movement device 49.

Figure 3:
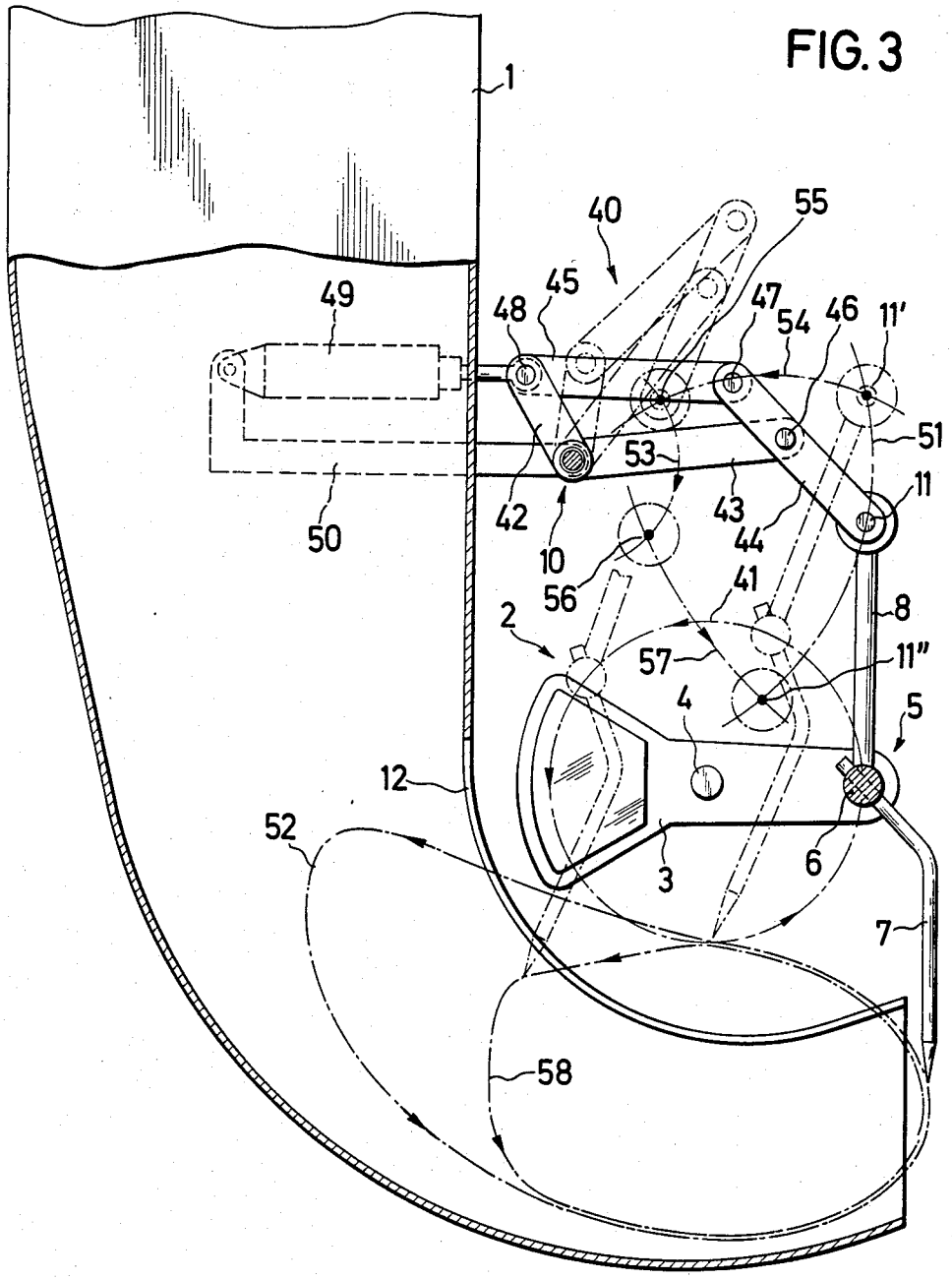
FIGS. 3 and 4 are cross-sectional views of embodiments of clearing devices with variable guide geometry.

In the embodiment depicted in FIG. 3, the guide system 40 is connected movably to a movement device 49 via the axle 48 and is in turn movably attached to a supporting arm 50 which can be turned about the turning point 10.

Provided it is ensured by means of the movement device 49 that the axle 48 is fixed in position relative to the turning point 10, the result is that the levers 42, 43, 44 and 45 cannot change their positions relative to one another, and hence the axle 11 must have a constant distance from the turning point 10. On turning the arm 3 and hence the teeth 7 mounted movably at the turning point 5 as well as the lever arm 8, the axle 11 moves forwards and backwards on a circular arc 51. The tip of the teeth 7, as a result, moves as indicated by the path 52 of FIG. 3. The corresponding end points of the motion of the axle 11 on the circular path 51 have been labeled in FIG. 1 as 11' and 11''.

A change in position by the movement device 49 necessarily leads to a change in the distance of the axle 11 from the turning point 10. On shortening the distance of the axle 11 from the turning point 10, the axle 11 must move about the turning point 10 in a circular path which has a smaller radius than the original path 51. As a result the teeth 7, when they fork into the contents of the chute 1, cannot any longer fork in as far as indicated by means of the curve 52. However, as a consequence a small amount of staple fibers is transported on per clearing motion.

In FIG. 3, an extremely short setting of the guide system 40 is drawn in with broken lines. Such a position of the levers 42, 43, 44, 45 and hence the positioning of the axle 11 on a circular path 53 is not preferable for continuous operation. On the contrary, such a pronounced change in radius of the circular arc on which the axle 11 is guided is only suitable for considerably reducing the amount conveyed by a single stroke. Operation of the device under these conditions requires that, after the axle 11 has reached the end point 11' and as a result of actuation of the movement device 49, the axle 11 is first of all moved on a path 54 to the desired new position of the axle, identified as 55. On further movement of the teeth on the circular path 41 the axle 11 moves on the small circular arc 53. It is then necessary for the movement device to return the guide system back into position. This can be done, for example, when the end point 56 has been reached, the result being that the axle 11 leaves the path 53 and is guided on a curve-shaped path 57 toward the lower end point 11''. Under these conditions the tips of the teeth 7 execute a movement which has been characterised by the traced curve 58. On comparing the traced curves 52 and 58 it becomes clear that guiding the teeth tips along the traced curve 58 will of course transport a significantly smaller amount per clearing motion, i.e. per revolution of the arm 3.

It may also be pointed out, as a supplementary, that the stabilizing action of the lever system 42, 43, 44, 45 can be dispensed with provided the movement device 49 can be held in defined positions. Under these conditions, the piston rod of the movement device 49 can be directly connected to the lever arm 8 via the axle 11.

Figure 4:
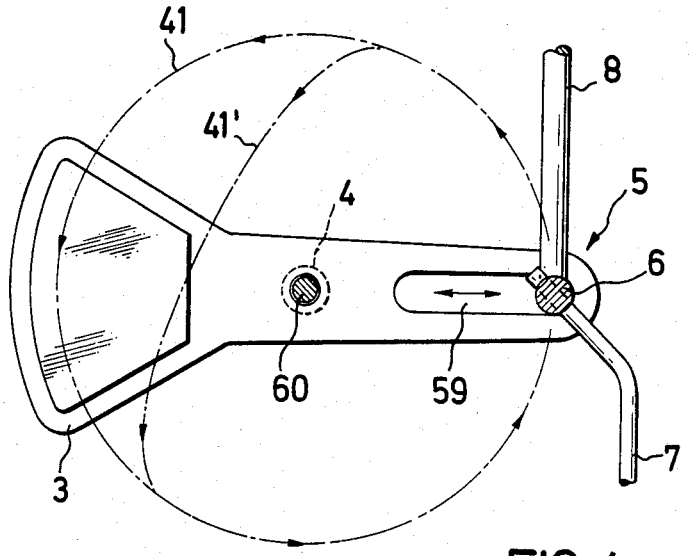
Figure 5:
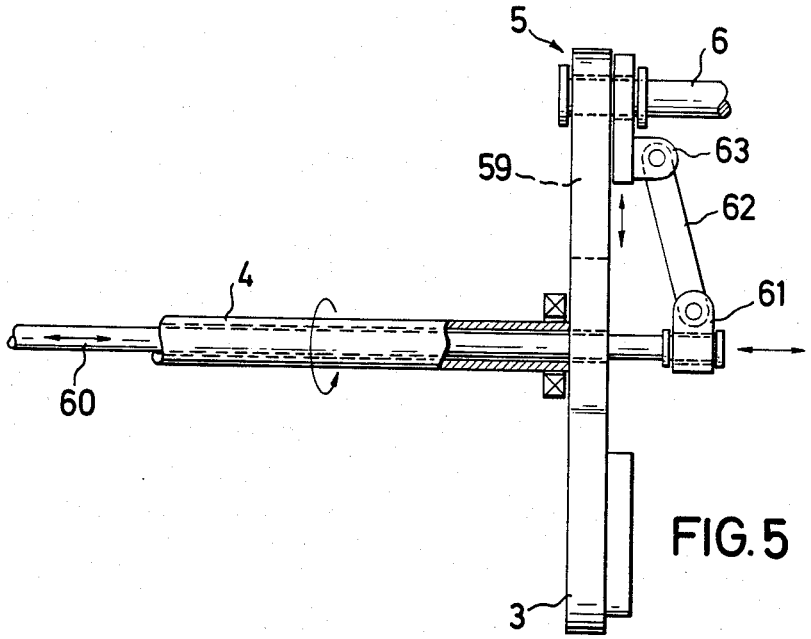
FIG. 5 is a plan view rotated by 90° of the details shown in FIG. 4 of a clearing device.

Another way of changing the clearing device geometry affecting the size of the push is presented in FIGS. 4 and 5. FIG. 4, like FIG. 3, depicts a cross-section through parts of the clearing device. As can be seen, however, the axle 6, which supports the teeth 7, is mounted in an elongated hole 59 in arm 3. Depending on the distance at which the axle 6 rotates about the axle 4, there are necessarily different paths of the tips of the teeth 7.

In the case of a method of operation where only the amount conveyed by the final push has to be reduced, this can be accomplished by reducing the distance of the axle 6 from the axle 4 only for the final turning motion which is required of arm 3. The axle 6 then traces out, for example, path 41'.

Control of the position of axle 6 relative to axle 4 in the arrangement shown in FIG. 3 can be effected by designing the axle 4 as a hollow axle in which a non-rotating rod 60 has been so mounted as to be shiftable in the direction of the axle 4. The rod 60 has at one of its ends a mounting 61 with a movably attached connection rod 62. This connection rod 62 is in turn connected to a bearing 63 for guiding the axle 6 in the elongated hole 59. When the connection rod 62 is parallel to the arm 3, the axle 6 is in the position furthest auay from the axle 4, and as the rod 60 is extended the rod 62 can only be at an angle to the arm 3, the distance between the axles 4 and 6 being markedly shortened as a result.

Devices of this type can, according to the invention, be incorporated in different process variants. For one, it is possible, after a predetermined number of clearing motions, as described in the main application, to, determine the weight and the average weight of staple fibers per clearing motion. Subsequently it is then possible to calculate the minimum number of pushes by the clearing device which will reduce the average weight of staple fibers per clearing motion to exactly such an extent, by changing the geometry of the clearing device, that the predetermined target weight is reached with an integral number of pushes.

If, for example, after about half the number of probably necessary clearing motions the weight in the press container and the average weight of staple fibers per clearing motion are determined, it may be sufficient, for example, to reduce the distance between the axle 11 and the turning point 10 by a very small amount in order to accomplish the desired reduction of conveying rate for the subsequent large number of clearing motions.

However, it is a precondition for this process to function that the staple fibers are piled up very evenly in the chute 1 and that any fluctuations in the amount conveyed per clearing motion are only low.

A procedure relatively unaffected by deposition fluctuations comprises first of all determining as described, after a specific number of clearing motions with maximum stroke, the weight and the average weight of staple fibers per clearing motion as well as the number of clearing motions still required. However, this is then followed by weighing the transportable press container, plus contents, once more shortly before reaching the target number of clearing motions with maximum stroke. The repeated weighing and calculation of the average amount conveyed per clearing motion gives an updated number of clearing motions still required with maximum stroke and also a decision whether an additional clearing motion with much reduced stroke is necessary for reaching the target weight. In this process, maximum stroke is thus used right up to the penultimate clearing motion, and a weighing as a check then provides the information whether the target weight has already been reached within the given limits or whether an additional clearing motion of the clearing device with, if appropriate, much reduced stroke is necessary. In such a case, the movement device 49 as in the illustrative embodiment of FIG. 3 would then be actuated at the moment when the axle 11 has reached its upper dead center point at 11'. The axle 11 and hence the lever arm 8 would then be guided along the curve 54 to the new upper dead center point 55, from where the axle 11 would then follow the circular path 53. This marked shortening of the distance between the axle 11 and the turning point 10 makes it necessary to ensure that there is a guarantee that the axle 11 can run back in time to the lower dead center point 11'', for example along the curve 57, since with such a marked reduction in the radius of the circular arc 51 to that of the circular arc 53 a fracture could arise in the machine if a resilient element has not been installed. A simple way of solving this problem is either to install correspondingly resilient safety members or to drive the movement device 49 pneumatically and control it from only one side.

What is claimed is:

1. In a process for packing staple fibers into bale form by multistage pressing which involves introducing the staple fibers by means of a clearing device in pushsized batches into a transportable press container and precompacting each time the amount of fiber from several pushes by the clearing device by means of a pressing ram and then subjecting the filled transportable press container to a final pressing in a central press, the improvement comprising first of all subjecting the empty press container to a weighing in which the press container is freed from touching sealing devices, lifted by lifting devices and weighed by load-measuring devices mounted thereon, and the press container is then put down again, the sealing devices are closed and the lifting devices are pivoted out, then starting with the usual filling and precompacting, the number of clearing motions being monitored, determining the weight and the average weight of staple fibers per a clearing motion after a predetermined number of clearing motions, and therefrom calculating the number of clearing motions or pushes still required for reaching a target weight, and then carrying out these motions or pushes in conventional manner until the target weight is reached.

2. The process as claimed in claim 1, wherein the transportable press container with contents is weighed once more shortly before reaching the target number of clearing pushes and then, if necessary, the number of clearing motions still to be performed is corrected.

3. The process as claimed in claim 2, wherein there is present, in addition to the clearing device, a small metering device with which smaller amounts of staple fibers per metering unit are added than with a full clearing stroke.

4. The process as claimed in claim 1, wherein the amount of loose fiber transported per clearing motion is regulated by adjusting the clearing device geometry affecting the push.

5. The process as claimed in claim 1, wherein, after a predetermined number of clearing motions with maximum push and determination of the weight of staple fibers in the press container and of the average weight of staple fibers per clearing motion, the size of push by the clearing device is reduced to such an extent that the target weight is reached exactly with a minimum integral number of further clearing motions.

6. The process as claimed in claim 2, wherein, shortly before reaching the target number of clearing motions with maximum push, a further weighing is carried out and the number of clearing motions with maximum push still to be carried out and, if necessary, a single additional clearing motion with reduced push are fixed and performed in order to reach the required target weight.

7. In a press for depositing and prepressing staple fibers in a transportable press container where the staple fibers are accumulated in a chute and then introduced by a clearing device in pushsized batches into the press container, the improvement comprising the press having lifting devices (18, 18') for the transportable press container (17) arranged to lift the press container (17) from a container base (19), load-measuring devices (30) fixed on the lifting devices (18, 18') in such a way that on using the lifting devices, they support the press container (17), movable seals (32) between an upper part of the press (14) and the press container (17) removable from the press container (17), movement devices (33–39) connected to manipulate the movable seals, and control devices for controlling the movement devices and also for determining the tare weight of the empty container, the filling weight after a predetermined number of clearing pushes of fiber into the container, the average weight per clearing push as well as the number of clearing pushes still required for reaching a predetermined target value.

8. The press as claimed in claim 7, including a further metering device for adding smaller unit weights of loose fiber than the clearing device.

9. The press as claimed in claim 7, wherein the clearing device has teeth (7), and means for manipulating the teeth into and out of the chute for controlling the staple fibers introduced into the press container.

10. The press as claimed in claim 7, wherein the clearing device includes teeth (7) connected to axle means (6) for rotation about a fixed pivot point (4).

* * * * *